United States Patent [19]

Kobayashi et al.

[11] Patent Number: 4,880,096

[45] Date of Patent: Nov. 14, 1989

[54] BILL VALIDATOR

[75] Inventors: Osamu Kobayashi, Tsurugashima; Hiroshi Hayashi; Ryoji Yamagishi, both of Sakado, all of Japan

[73] Assignee: Kabushiki Kaisha Nippon Coinco, Tokyo, Japan

[21] Appl. No.: 25,938

[22] Filed: Mar. 16, 1987

[30] Foreign Application Priority Data

Mar. 18, 1986 [JP] Japan ..... 61-38292
Jul. 14, 1986 [JP] Japan ..... 61-10672

[51] Int. Cl.[4] ..... G07D 7/00

[52] U.S. Cl. ..... 194/206; 209/534; 221/198

[58] Field of Search ..... 194/206, 207, 350; 221/198; 209/534; 271/177, 180, 181

[56] References Cited

U.S. PATENT DOCUMENTS 4,540,081 9/1985 Mori et al. ..... 209/534 X
4,678,072 7/1987 Kobayashi et al. ..... 209/534 X

FOREIGN PATENT DOCUMENTS 54-130097 10/1979 Japan ..... 194/207

*Primary Examiner*—F. J. Bartuska
*Attorney, Agent, or Firm*—Spensley Horn Jubas & Lubitz

[57] ABSTRACT

A bill validator including a vertically extending main body having a bill insertion slit, bill conveying passage, and a bill discrimination device provided along the bill conveying passage, and a bill accumulating box detachably mounted on the main body. The main body can be turned upside down, along with the bill insertion slit, bill conveying passage and bill discrimination device configured therein. The bill accumulating box is selectably mounted on the main body in a normal state or in an upside down state such that the vertical position of the bill accumulating box will not be changed when the main body is turned upside down. Thus, the same bill validator may be used as a type with the bill insertion slit provided at the upper portion or at the lower portion thereof, respectively, as desired for use with different vending machine configurations.

7 Claims, 11 Drawing Sheets

BILL VALIDATOR

BACKGROUND OF THE INVENTION

This invention relates to a bill validator used for vending machines, exchanging machines, service machines or the like (hereinafter referred to as "vending machine").

There are generally two types in a bill validator used for this purpose, namely one type in which a bill insertion slit is provided in the upper portion of the bill validator and the other type in which a bill insertion slit is provided in the lower portion thereof, respectively for adapting to a mounting space available in a mounting side (i.e., the vending machine side).

If the same bill validator can be used for both of these types by simply changing disposition of the bill insertion slit from the upper portion to the lower portion or vice versa or by simply turning the bill validator itself upside down, the manufacturing cost of the bill validator will be considerably reduced and besides maintenance of the bill validator will be facilitated.

The mere change in disposition of the bill insertion slit or turning of the bill validator upside down is accompanied by the problem that bills will be scattered during inventory of collected bills. That is, collected bills must be taken out by opening the upper end of a bill collecting section during inventory but such change in disposition of the bill insertion slit or turning of the bill validator upside down will cause the bill collecting section to open in the lower end thereof with resulting scattering of bills.

Further, the bill insertion slit generally has means for preventing a water drop from entering the bill insertion slit from above but it has no preventive means against a water drop entering the bill insertion slit from below and, accordingly, mere turning of the bill validator upside down leaves a problem in waterproof characteristic of the bill validator.

For these reasons, there are the two types of bill validators, i.e., one with the bill insertion slit provided in the upper portion and the other with the bill insertion slit provided in the lower portion despite the fact that both have common devices such as bill discrimination means and bill collection means.

On the other hand, there is a known bill validator (e.g., Japanese Preliminary Patent Publication No. 77288/1985) which comprises conveying means for conveying inserted bills, discrimination means for discriminating a true bill from a false one among inserted bills on the way they are conveyed, temporary retention means for temporarily retaining a bill which has been judged to be a true bill, reverse feeding means for feeding the bill temporarily retained by the temporary retention means reversely to a bill insertion slit in response to a bill return command issued by a vending machine, and accumulation means for stacking the temporarily retained bill in an accumulating box in response to a bill collection command issued by the vending machine.

In this prior art bill validator, a shutter for preventing pulling out of the temporarily retained bill is provided in a post stage of a magnetic sensor which constitutes a component part of the discrimination means. This is because a bill cannot be temporarily retained unless discrimination by the discrimination means has been completed. In the prior art discrimination means, a transmitted light amount sensor for detecting thickness or pattern of the bill and a photo sensor for detecting the size of the bill are provided in the post stage of the magnetic sensor and discrimination of the bill is made on the basis of results of detection by these sensors.

In such prior art bill validator in which the bill pulling out preventing shutter is provided in the post stage of the magnetic sensor, the inserted bill is temporarily held at a position after the bill has passed by the magnetic sensor and this gives rise to the problem that, in returning the temporarily retained bill, the end portion of the bill sometimes fails to smoothly enter a space defined between the magnetic sensor and a pinch roller which is provided for holding the bill in association with the magnetic sensor with a result that the end portion of the bill is folded and the bill cannot be returned to the bill insertion slit or, if the bill has been returned, the returned bill has its end portion wrinkled or cut off. If a spring of a weaker urging force is used for the pinch roller with a view to preventing occurrence of such problem, there arises the inconvenience that the surface of the bill fails to contact the magnetic sensor with resulting failure in obtaining sufficient data for discrimination of the inserted bill.

SUMMARY OF THE INVENTION

It is, therefore, an object of the invention to provide a bill validator of reduced manufacturing cost and facilitated maintenance in which location of the bill insertion slit can be turned upside down by simply changing mounting positions of a few component parts and in which the bill accumulating box can be mounted upside down in such a manner that collection of bills can be performed always from above regardless of the location of the bill insertion slit thereby enabling mounting of the bill validator itself upside down whereby the same bill validator can be mounted in both mounting positions of the upper bill insertion slit position and the lower bill insertion slit position required depending upon the type of the vending machine to which the bill validator is mounted.

It is another object of the invention to provide a bill validator capable of returning a temporarily retained bill smoothly without being blocked at the location of the magnetic sensor.

The bill validator achieving the first described object of the invention comprises a vertically extending main body, a bill insertion section provided in the front portion of the main body, bill conveying means including a first conveying passage extending from the bill insertion section into the main body and a second conveying passage extending vertically in the longitudinal direction of the main body for conveying a bill inserted from the bill insertion section along the first and second conveying passages, discrimination means for discriminating a true bill from a false bill among bills inserted from the bill insertion section, a bill accumulating box detachably mounted in the rear portion of the main body, and accumulation means for transferring a bill which has been estimated to be a true bill from the second conveying passage to the bill accumulating box in the rear of the second conveying passage thereby to accumulate the bill in the bill accumulating box. The bill accumulating box includes a first projection provided in the upper portion of a side thereof and a second projection provided in the lower portion of the side thereof. The main body is provided on a side thereof with a latch member engaging with the first projection and a support member supporting the bill accumulating box through the second projection. The latch member is displaceable between a holding position and a releasing position, is engaged with the first projection in the holding position and, in the releasing position, is disengaged from the first projection and thereby is capable of tilting the bill accumulating box rearwardly about a point of engagement between the support member and the second projection. The bill accumulating box is mounted to the main body in an upside down state or not in an upside down state in such a manner that the first projection of the bill accumulating box is positioned above the second projection in both cases where the main body with the bill insertion section, bill conveying means, discrimination means and accumulation means is used in an upside down state and where the main body is used not in an upside down state, and, in accordance with this mounting, mounting positions of the latch member and the support member in the main body is changed to positions corresponding to the first and second projections.

For example, it is assumed that in a state in which the main body is not turned upside down (hereinafter referred to as "normal type"), a bill insertion section is located in the upper portion of the main body whereas in a state in which the main body is turned upside down (hereinafter referred to as "upside down type"), the bill insertion section is located in the lower portion of the main body (this assumption may of course be in a reversed state). The bill accumulating box can be detached in the rear portion of the main body and its mounting position in the main body can be turned upside down. In a state in which the main body is not turned upside down (i.e., normal type), the bill accumulating box is mounted to the main body in such a manner that the first projection of the bill accumulating box is positioned above the second projection. The state of mounting of the bill accumulating box to the main body is referred to, e.g., "not in an upside down state". In this state, the latch member provided on a side of the main body is mounted in the upper portion so as to correspond to the first projection of the bill accumulating box. The support member is mounted in the lower portion of a side of the main body so as to correspond to the second projection of the bill accumulating box. Thus, the latch member and the support member provided on the main body side are engaged respectively with the first and second projections provided on the bill accumulating box side and the bill accumulating box is mounted in the rear portion of the main body with the first projection being located in the upper portion. In this state, the bill insertion section is located in the upper portion of the main body.

In a case where the bill insertion section is to be located in the lower portion of the main body, the main body is turned upside down with the bill insertion section, bill conveying means, discrimination means and accumulation means (i.e., upside down type). In this state, the vertical relation of the bill accumulating box relative to the main body is reversed from the above described state. That is, the state of mounting of the bill accumulating box relative to the main body becomes "upside down state". Since the main body itself is turned upside down, the bill accumulating box which is turned upside down relative to the main body is in a state in which the bill accumulating box is not turned upside down in appearance so that the bill accumulating box is mounted to the main body with the first projection being positioned above the second projection. In this state, the mounting position of the latch member provided on a side of the main body is changed to the upper portion (lower portion in the normal type) so as to correspond to the first projection of the bill accumulating box and the mounting position of the support member is changed to the lower portion (upper portion in the normal type) of the side of the main body so as to correspond to the second projection of the bill accumulating box. In this manner, the latch member and the support member provided on the main body side can be engaged with the first and second projections provided on the accumulating box side so that the bill accumulating box can be mounted in the rear portion of the main body with the first projection being positioned above. In this state, the bill insertion section is located in the lower portion of the main body.

In the above described manner, the vertical position of the bill accumulating box can be maintained constant whether the bill validator is a normal type or upside down type (i.e., the first projection is always above the second projection) so that accumulation of bills can be performed without trouble. If an opening for collecting bills is provided in the upper portion of the bill accumulating box, this opening is always located in the upper portion so that collection of bills can be performed without any trouble. Accordingly, the same bill validator can be used for both the type in which the bill insertion section is provided in the upper portion and the type in which the bill insertion section is provided in the lower portion by simply changing the mounting positions of the latch member and the support member in the main body.

The bill insertion section preferably comprises a case having an opening communicating with the first conveying passage as a bill insertion slit and a cover covering the bill insertion slit of this case. The cover has a pivot at an end thereof and the case is provided in the upper and lower portion thereof with support portions capable of detachably supporting the pivot of the cover. Since the support portions are provided both in the upper and lower portions of the case, the pivot of the cover can be mounted to one of the support portions so that the cover covers the bill insertion slit with the pivot of the cover being positioned in the upper portion thereof in both cases where the main body is used in an upside down state and where the main body is used not in an upside down state. By this arrangement, the cover can always cover the bill insertion slit with the pivot of the cover being positioned above in both the normal type and the upside down type so that invasion of rain from the bill insertion slit can be prevented. Further, the bill insertion slit can be opened by lifting the cover upwardly about the pivot in both the normal type and the upside down type.

The bill validator achieving the other object of the invention comprises a bill insertion slit, bill conveying means including a conveying passage communicating with the bill insertion slit and conveying a bill inserted from the bill insertion slit along the conveying passage, and discrimination means for discriminating a true bill from a false one among bills inserted from the bill insertion slit. The discrimination means includes component elements for discriminating the bill along the conveying passage. The component elements include at least a magnetic sensor which is disposed at the rearmost location of the arrangement of the component elements. A bill pulling out preventing member is provided in a stage prior to the magnetic sensor and this member projects into or withdraws from the conveying passage. There are also provided drive means for withdrawing the bill pulling out preventing member from the conveying passage when the bill is inserted and returned, detection means for detecting that the rear end of the inserted bill which is being conveyed along the conveying passage has passed by the location of the bill pulling out preventing member, and temporary retention means for temporarily retaining the bill in the conveying passage by stopping conveying of the bill in response to an output of the detection means. There are further provided reverse feeding means for reversely feeding the bill which has been temporarily retained by the temporary retention means to the bill insertion slit along the conveying passage in response to a bill return command, a bill accumulating box for accumulating accepted bills, and accumulation means for accumulating the bill which has been temporarily retained by the temporary retention means in the bill accumulating box in response to a bill collection command.

An inserted bill is conveyed by the conveying means and discrimination of a true bill from a false one is made by the discrimination means on the way the bill is conveyed. Since the magnetic sensor is located in the rearmost location of the arrangement of the component elements of the discrimination means, discrimination by all of the component elements of the discrimination means is completed when the rear end of the bill approaches this magnetic sensor. The bill pulling out preventing member is provided in a stage prior to the magnetic sensor and this member is withdrawn out of the bill conveying passage by actuation of the drive means to allow the bill to pass by this member. Upon detection by the detection means of passing of the rear end of the bill by the location of the bill pulling out preventing member, the bill conveying operation by the bill conveying means is stopped and the bill is temporarily retained. Since the bill pulling out preventing member is provided in the prior stage of the magnetic sensor, the rear end portion of the bill is still held between the magnetic sensor and the corresponding pinch roller when the rear end of the bill has passed by the location of this bill pulling out preventing member but discrimination of the bill has already been completed. Accordingly, conveying of the bill can be stopped and the bill can be temporarily retained in this state. For returning the temporarily held bill, the bill is reversely fed by the reverse feeding means. Since the end of the bill has already been held between the magnetic sensor and the corresponding pinch roller, there is no likelihood that the bill is blocked at this position or wrinkled but the bill is smoothly returned to the bill insertion slit.

BRIEF DESCRIPTION OF THE DRAWINGS

In the accompanying drawings.

DESCRIPTION OF PREFERRED EMBODIMENTS

Figure 4:
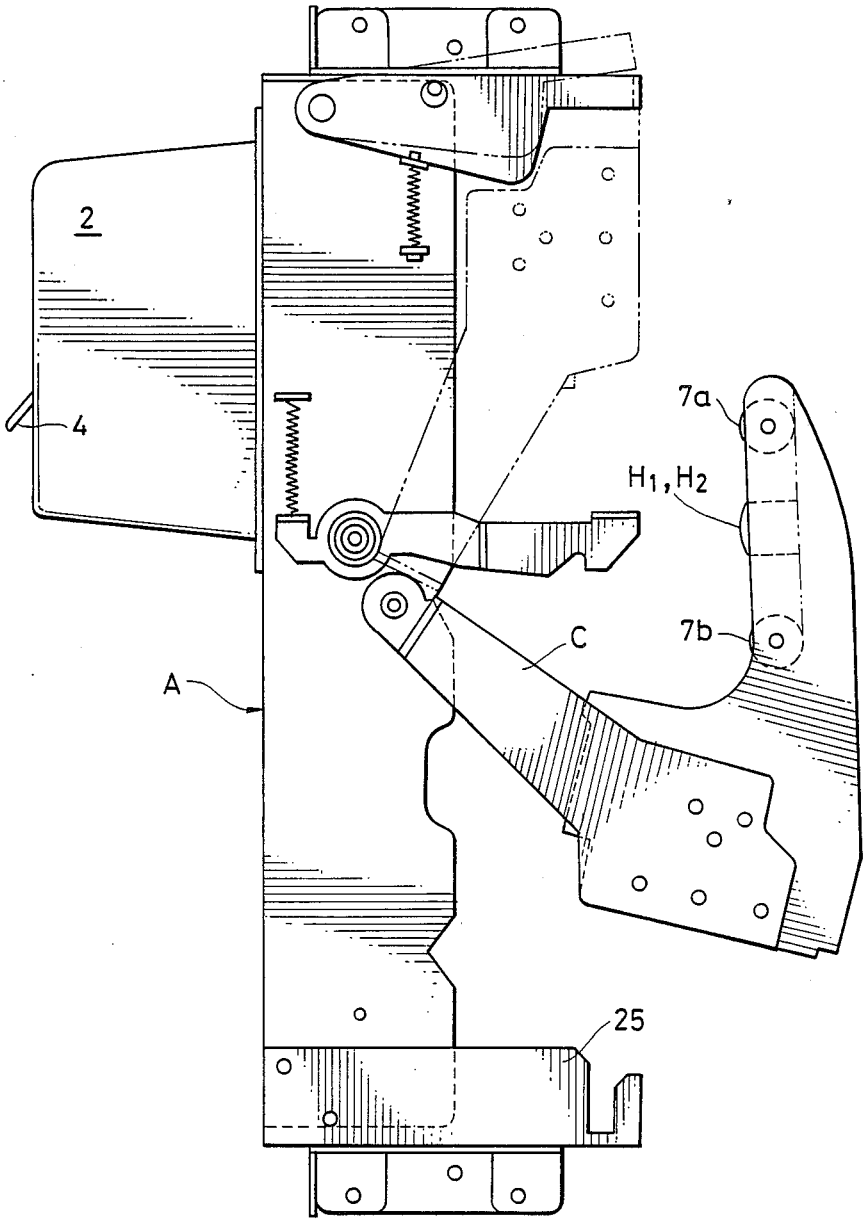
FIG. 4 is a side view of the same embodiment showing a state in which a bill conveying passage has been opened.
Figure 5:
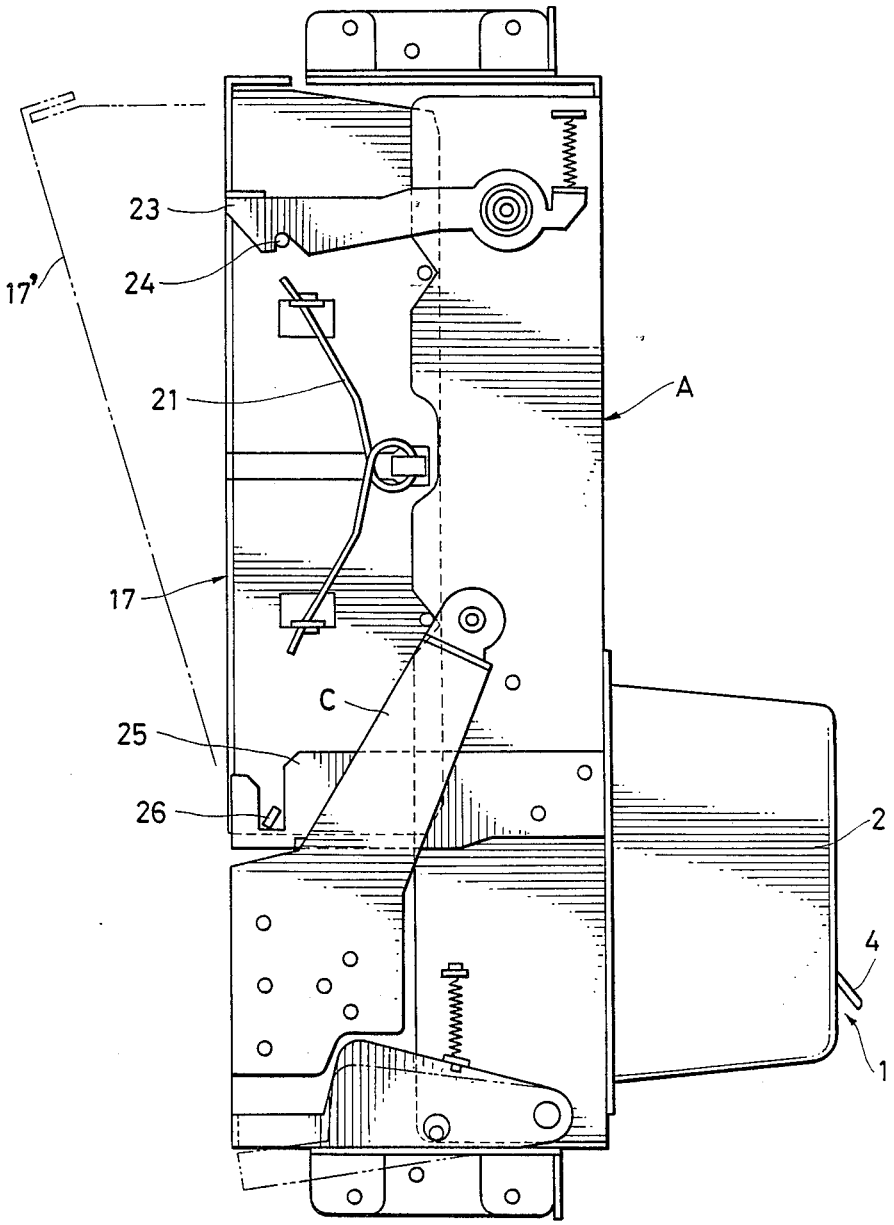
FIG. 5 is a side view showing an example in which the same embodiment has been switched to an upside down type.
Figure 6:
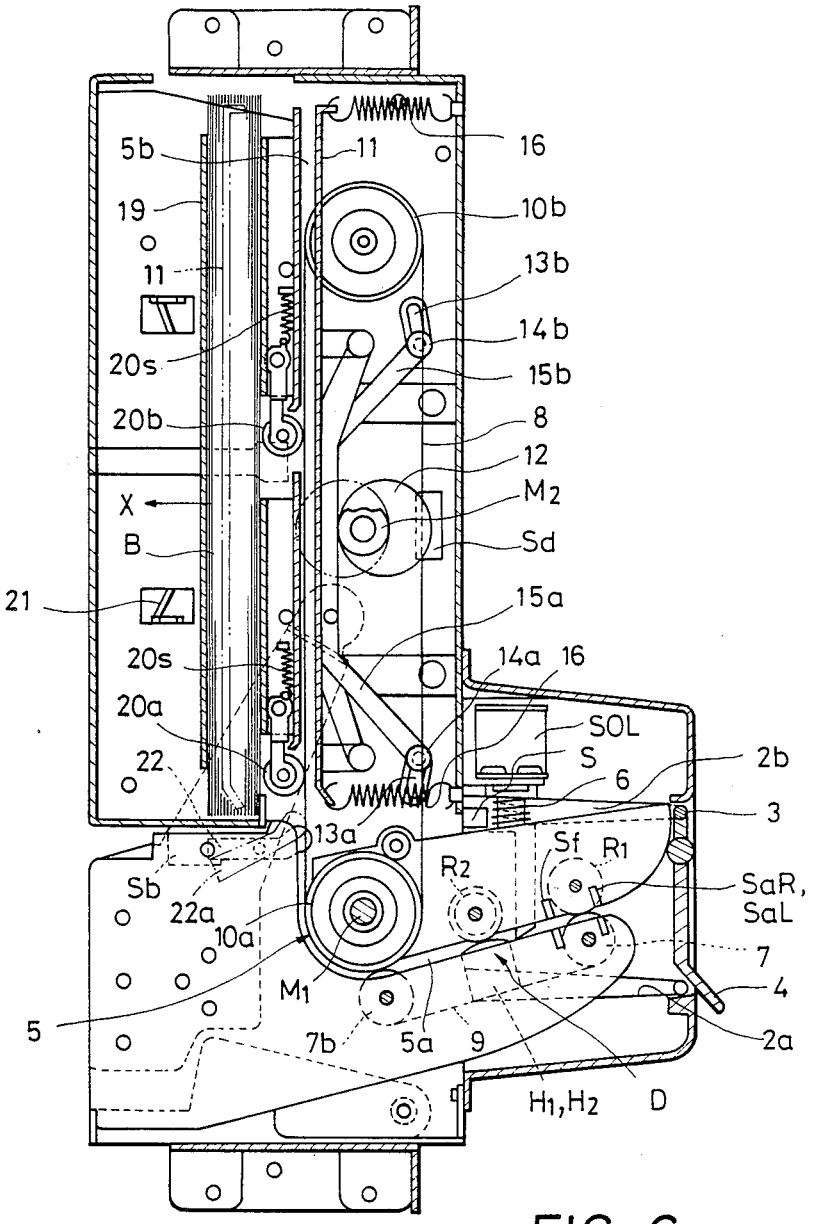
FIG. 6 is a sectional view of the example of FIG. 5.

An embodiment of the invention is illustrated in the drawings in which FIGS. 1 through 4 show a bill validator of a type in which a bill insertion slit 1 is provided in the upper portion of the device (hereinafter referred to as a "normal type") and FIGS. 5 and 6 show a bill validator of a type in which the bill insertion slit 1 is provided in the lower portion of the device (hereinafter referred to as an "upside down type").

In the following description, a case where the normal type bill validator is used will first be explained and then a case where the upside down type bill validator is used will be explained.

A main body A of the bill validator has a vertically long casing and has bill insertion slit 1 projecting forwardly in the upper portion of the casing.

The bill insertion slit 1 is enclosed by a case 2 which is detachable from the main body A. A bill insertion slit cover 4 which can be opened and closed at will is mounted on a pin 3 provided in a pair of channels **2*a* formed in both walls in the upper portion of the opened portion of the case 2. In the standby mode, the bill insertion slit 1 is closed by the cover 4 to prevent intrusion of a water drop or dust into the bill insertion slit 1. The case 2 is formed also in both walls in the lower portion of the opened portion thereof with a pair of channels 2*b*** which serve for mounting a cover therein when the bill validator is used as the upside down type bill validator.

When a bill is inserted, this cover 4 is lifted and the bill is inserted into the bill insertion slit 1.

In the main body A, a bill conveying device 5 is provided. This bill conveying device 5 consists of a front bill conveying passage **5*a* including a bill discriminating section D communicating from the bill insertion slit 1 to the inside of the main body A and a rear bill conveying passage 5*b* extending vertically and communicating with the front bill conveying passage 5*a***.

In the front bill conveying passage **5*a*, magnetic heads H1 and H2 are provided as means for discriminating a true bill from a false one. The magnetic heads H1 and H2 constitute a pair across the center line and detect magnetic ingredient contained in the printing ink. In the vicinity of the insertion slit 1, there are provided a pair of left and right bill sensors SaR and SaL for detecting the insertion of the bill, a sensor Sfc for detecting the amount of transmitted light and a shutter 6 which opens and closes the bill conveying passage by the control of a solenoid SOL. There are also provided front and rear pairs of pulleys 7*a* and 7*b* and bill conveying driven belts 9 which are in contact with bill conveying belts 8 and are driven thereby are stretched between these pulleys 7*a* and 7*b***.

This front bill conveying passage **5*a* is fixed in its upper portion to an arm C which is pivotably mounted on the side of the main body A so that the bill conveying passage can be opened as shown in FIG. 4** when it is checked up for maintenance purpose.

In the rear bill conveying passage 5b are provided a pair of bill conveying belts 8, a conveying motor M1 for driving these belts 8 and pulleys 10a and 10b transmitting rotation of this motor M1 to the belts 8. The rotation of the motor M1 is transmitted to the upper pair of pulleys 10a and the lower pair of pulleys 10b are thereby driven. In association with the conveying motor M1, there is also provided a rotation pulse generator (not shown) which generates an electric pulse signal in synchronism with the rotational position of the conveying motor M1. The generated pulse signal is used for producing bill position address data when discrimination of a true) bill from a false one is performed on the basis of outputs of the magnetic heads H1 and H2. The magnetism distribution on the surface of a bill exhibits a specific pattern in correspondence to address positions on the bill and the discrimination of bills for each denomination can be made in accordance with this pattern. Reference characters R1 denotes a driven roller and R2 a pinch roller for pressing the bill against the magnetic heads H1 and H2.

A reciprocating device for performing accumulation of bills is provided in one side (the side of the conveying belts 8) of the rear conveying passage 5b. This reciprocating device comprises a push plate 11 for pushing a bill conveyed on the conveying belts 8 in the direction of the surface of the bill and a mechanism for reciprocating this push plate 11 in accordance with rotation of a motor M2. There are provided a pair of eccentric cams 12 mounted eccentrically on the rotation shaft of the motor M2 and a pair of link rods 15a and 15b which are pivotally connected in one end portions thereof to the push plate 11 and connected in the other end portions thereof to pins 14a and 114b through slots 13a and 13b. As the motor M2 is rotated, the cams 12 are actuated to push the link rods 15a and 15b and the push plate 11 thereby is moved in translational movement in a normal direction to the surface of the plate. The push plate 11 is constantly urged to the cams 12 by the force of a spring 16 so that the push plate 11 is moved in reciprocating motion in association with the eccentric movement of the cams 12.

Figure 7:
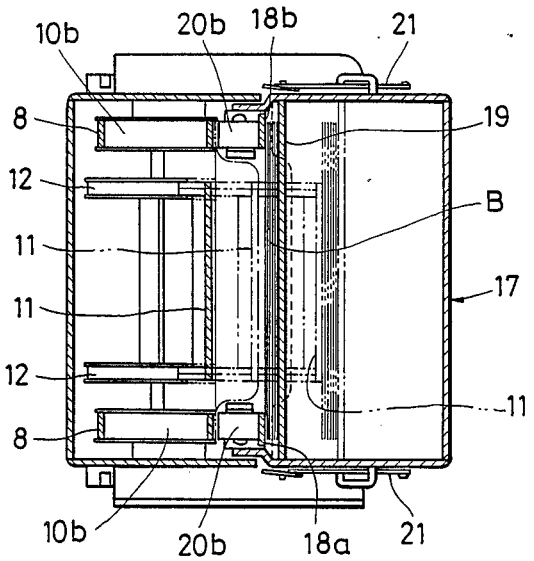
FIG. 7 is a cross sectional view taken along lines VII—VII in FIG. 1.

An accumulating box 17 for accumulating bills pushed by the reciprocating device is provided on the other side of the conveying passage 5b. As shown in FIG. 7, the accumulating box 17 has its entrance formed by a vertically disposed pair of parallel elongated bill support channel members 18a and 18b which are spaced from each other with a space therebetween being somewhat narrower than the width of the bill. A bill compressing plate 19 is provided in parallel to the channel members 18a and 18b and the push plate 11. This bill compressing plate 19 has breadth corresponding to the size of the bill. While the channel members 18a and 18b are stationary, the bill compressing plate 19 is movable in a translational motion in a normal direction to the surface of the plate. A part nearer to the conveying device 5 of each of the channel members 18a and 18b is cut off and the driven rollers 20a and 20b are provided in the recesses. These rollers 20a and 20b are always urged towards the belts 8 by the force of the springs 20s so that these rollers 20a and 20b are rotated while holding the bill conveyed with the moving belts 8 between them and the belts 8.

Figure 1:
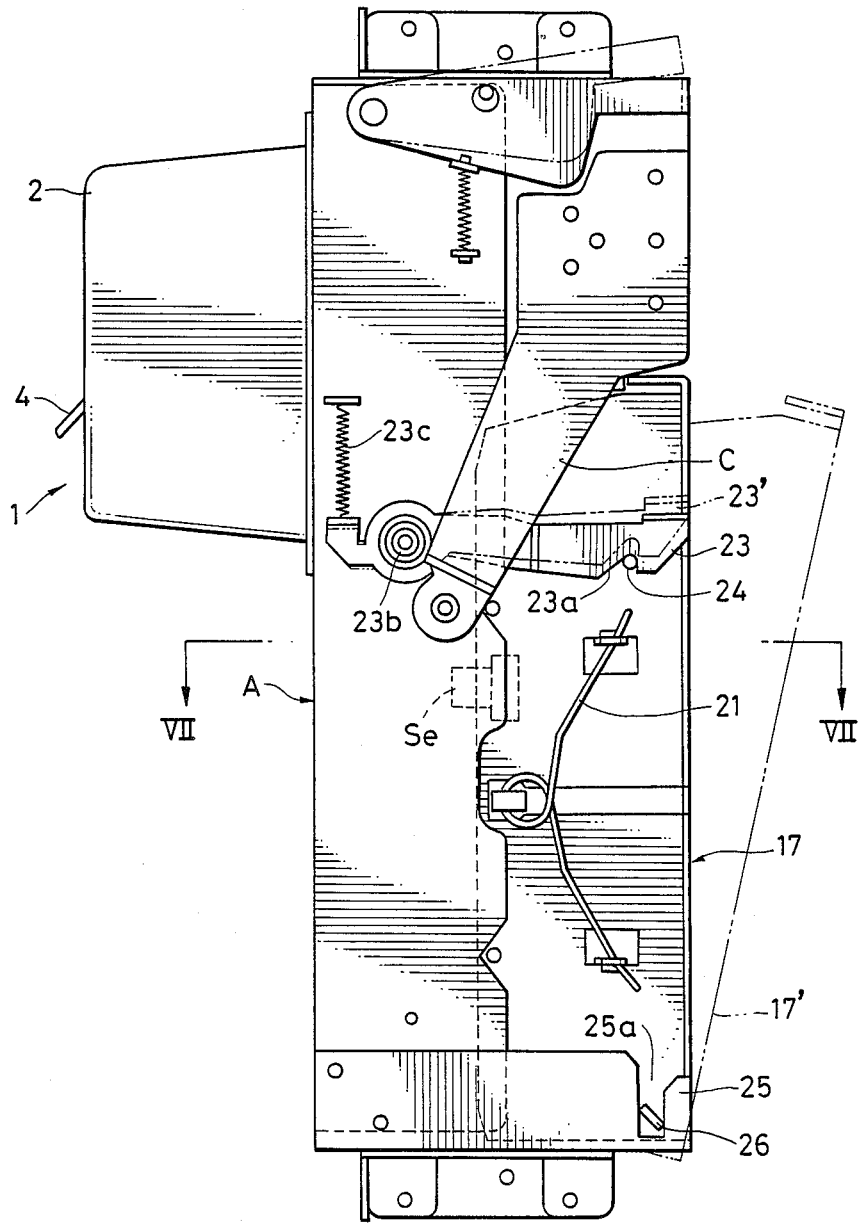
FIG. 1 is a side view of an embodiment of the bill validator according to the invention.
Figure 2:
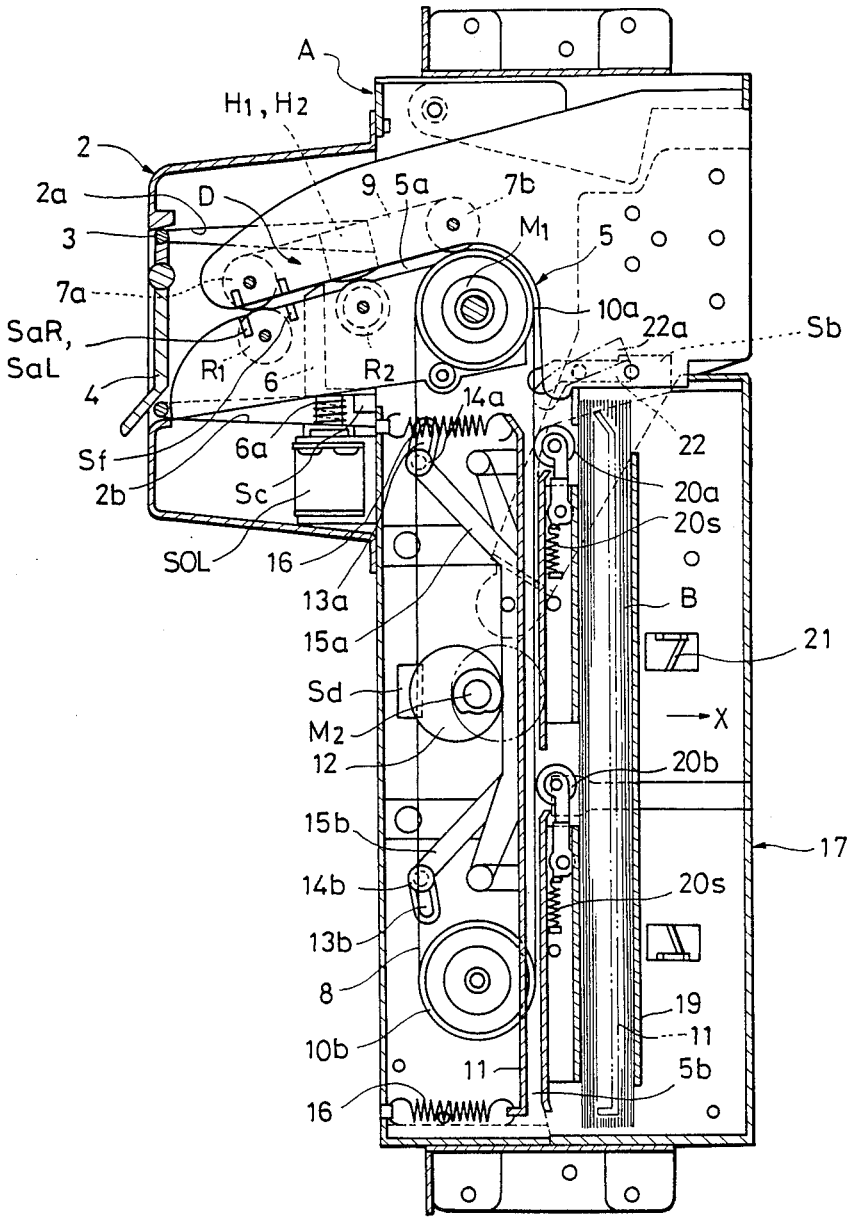
FIG. 2 is a sectional view of the same embodiment.
Figure 3:
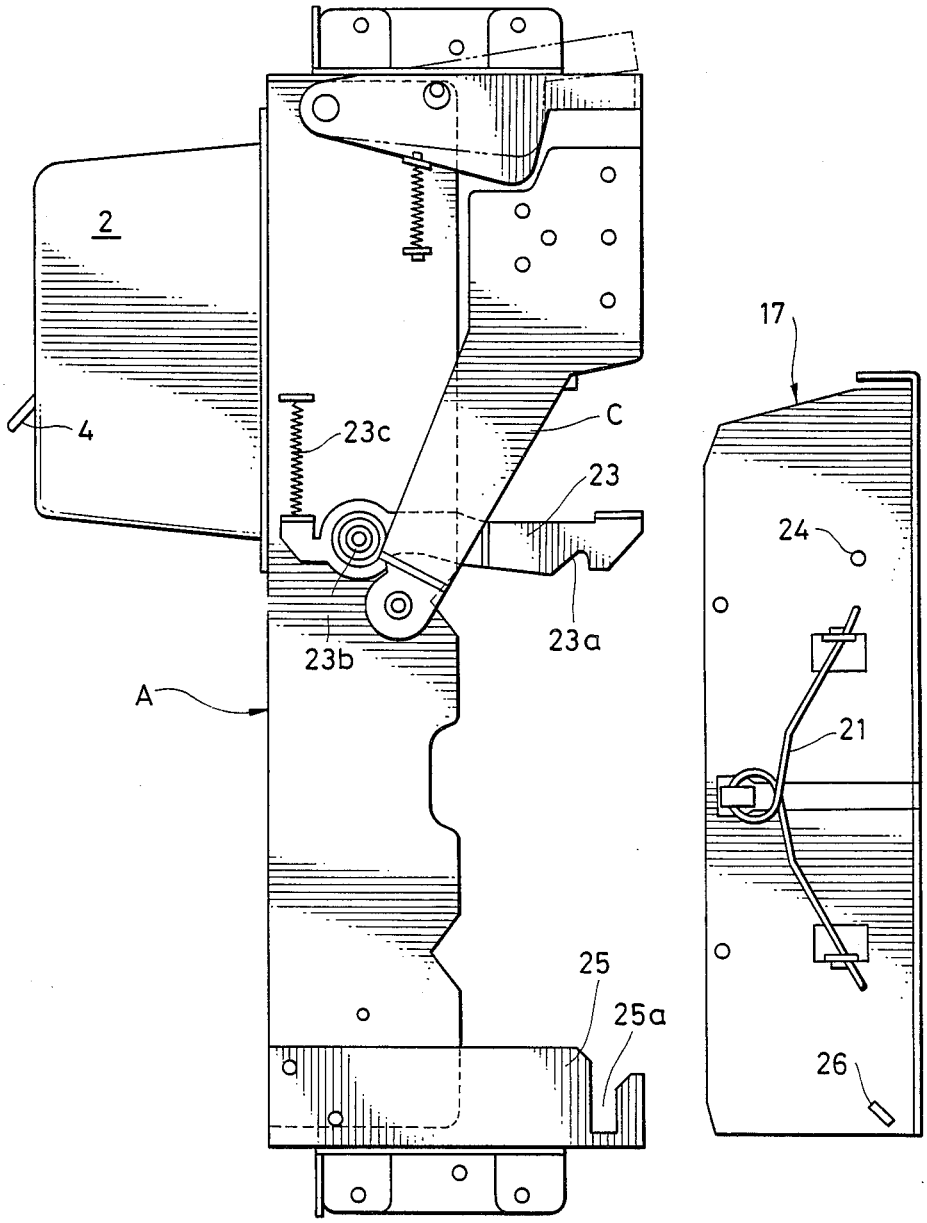
FIG. 3 is a side view of the same embodiment showing a state in which a bill accumulating box has been removed.

In a standby mode, the reciprocating device is in a state as shown in FIG. 2. In this state, the push plate 11 is in the furthest position from the accumulating box 17 and the space between this push plate 11 and the channel members 18a and 18b forms a passage for the bill.

A lever 22 is disposed in the rear of conveying passage 5b with an end portion thereof projecting in the passage 5b. The lever 22 is so constructed that it is pushed by a bill advancing in the forward direction (i.e., bill receiving direction) to withdraw automatically out of the passage but it functions as a stop against a bill moving in the reverse direction. A sensor Sb is provided for detecting the motion of this lever 22. This sensor Sb is turned on when the lever 22a has been withdrawn out of the passage as shown by a chain-and-dot line 22a during advancing of the bill and it is turned off when the lever 22 has returned to the passage.

Upon detection of insertion of a bill by the sensor Sa, the solenoid SOL is energized, the shutter 6 is withdrawn from the passage and the conveying motor M1 is rotated forwardly to convey the inserted bill forwardly by the bill conveying device 5. In the conveying process, validation of the bill is made on the basis of the outputs of the magnetic heads H1 and H2. If the bill is a false one, the motor M1 is reversely rotated to immediately return the bill to the depositor.

If the bill has finally been judged to be a true bill, the shutter 6 is caused to abut lightly against the surface of the bill by the spring 6a of the solenoid SOL. Upon lapse of a predetermined period of time after the rear end of the forwardly conveyed bill has passed by the lever 22 causing the switch Sb to turn off from the on-state, the forward rotation of the motor M1 is stopped so that the inserted bill is stopped at a position in front of the push plate 11. Then the motor M2 is forwardly rotated to perform the bill accumulating operation for accumulating bills in the bill accumulating box 17.

A carrier switch Sd is mounted on the rotation shaft of the motor M2 so as to rotate the motor M2 by one rotation during the bill accumulating operation. In response to one rotation of the motor M2, the eccentric cams 12 are rotated by one rotation and the push plate 11 thereby is moved in one reciprocating motion.

When the push plate 11 approaches the bill compressing plate 19, the push plate 11 passes between the channel members 18a and 18b while pushing the bill in the conveying passage (at this time, the bill passes through the channel members 18a and 18b in a flexed shape) and moves the bill compressing plate 19 in the direction of arrow X against the force of the springs 21 while pressing the bill to the bill compressing plate 19. There is produced a space between the channel members 18a and 18b and the bill compressing plate 19 and the pushed bill enters this space. FIG. 2 shows, by a chain-and-dot line, a state where the reciprocating member has moved in translational motion by a maximum distance. In this state, the eccentric cams 12 have rotated by half rotation. By the remaining half rotation of the eccentric cams 12, the push plate 11 returns in the direction of arrow X and the bill compressing plate 19 is pushed towards the channel members 18a and 18b by the force of the springs 21 provided on both sides of the box 17. Upon abutting engagement of both sides of the bill with the channel members 18a and 18b, the movement of the bill compressing plate 19 is stopped and the bill is compressed and held between the members 18a and 18b and the bill compressing plate 19. The push plate 11 is restored to the original position by the force of the spring 16, leaving the clamped bill in the box 17. In this manner, a number of bills B are accumulated between the channel members 18*a* and 18*b* in the box 17 and the bill compressing plate 19.

A pair of pins 24 which engage in recesses 23*a* of latches 23 are provided in the upper portions of left and right sides of the box 17 and a pair of engaging members 26 which engage in recesses 25*a* of supports 25 are provided in the lower portions of both sides of the box 17.

The left and right latches 23 and the supports 25 are detachably mounted on both sides of the main body A. The mounting positions of the latches 23 and the supports 25 are reversed depending upon whether the device is used as the normal type or the upside down type.

The latches 23 consist of levers which are pivotably mounted on the main body A by means of a pin 23*b* and is urged by tension springs 23*c* in a direction in which they are caused to engage with the pins 24 By lifting the latches 23 by a small distance such as denoted by a reference character 23' (FIG. 1) against the force of the springs 23*c*, the box 17 can be tilted as denoted by a reference character 17' about the engaging members 26. By further lifting the box 17 obliquely and rearwardly upwardly, it can be detached from the main body A. In a state wherein the box 17 has been detached from the main body A, the accumulated bills in the box 17 can be readily taken out.

A safety switch Se is provided on the main body side in association with this box 17 for detecting that the box 17 has been detached from the main body thereby to stop driving of the motors M1 and M2 and prohibiting deposition of a bill when the box 17 has been detached. During the accumulating operation of bills in the box 17 by the rotation of the motor M2, it is desirable to prohibit additional deposition of a bill. For this purpose, an arrangement is made so that, when the sensor Sa provided at the insertion slit 1 has detected a bill, rotation of the conveying motor M1 is prohibited (or the motor M1 is reversely rotated) for prohibiting deposition of a bill.

When the bill accumulating box 17 has become full with accumulated bills, further receiving of a bill is impossible so that insertion of an additional bill should be prohibited. For this purpose, some sort of fullness detection means should preferably be provided so that the rotation of the conveying motor M1 is stopped when the full state of the accumulation box has been detected or the motor M1 is reversely rotated to automatically return a deposited bill when the sensor Sa at the insertion slit 1 has detected the bill. As such fullness detection means, for example, a sensor may be provided at a suitable fullness detecting position in the box 17 or some means may be provided for detecting that the number of bills has reached a set maximum number by detecting that a load exceeding a predetermined value has been applied to the accumulating motor M2. For example, such application of a load exceeding a predetermined value to the motor M2 can be detected by detecting whether or not the carrier switch Sa has maintained the on state for more than a predetermined length of time. That is, when the accumulated number of bills has reached the maximum, the bill compressing plate 19 does not move in the direction of arrow X further and the rotation of the motor M2 is thereupon interrupted. In this case, the motor M2 may be reversely rotated to the standby state shown in FIG. 2 so that removal of the accumulating box can be effected without trouble.

In a case where the bill validator is used as the upside down type, the main body A is turned upside down as shown in FIG. 5 and the mounting positions of the latches 23 and the supports 25 are changed as illustrated. More specifically, the pin 3 of the cover 4 is mounted on the side of the channel 2*b* of the case 2. In order to prevent the accumulating box 17 from being turned upside down when the main body A has been turned upside down, the accumulating box 17 is once detached from the main body A and is mounted in the main body A again after the box 17 is inverted relative to the main body A. At this time, the channel members 18*a* and 18*b* should preferably be remounted so that the orientation thereof relative to the box 17 is inverted. FIG. 6 shows an example in which the channel members 18*a* and 18*b* are remounted in such a manner. The channel members 18*a* and 18*b* however need not necessarily be remounted. Since the mounting positions of the latches 23 and the supports 25 are inverted relative to the main body A which has been turned upside down and the box 17 also is turned upside down, the latches 23 and the supports 25 can engage with the pins 24 and the engaging members 26 as shown in FIG. 5. In this case also, by disengaging the latches 23 from the pins 24, the box 17 can be opened as shown by a chain-and-dot line 17'.

A pair of right and left sensors SaR and SaL provided in the vicinity of the bill insertion slit 1 consist respectively of a light emitting element and a light receiving element and are capable of detecting insertion of a bill and its width by interruption of light by the bill. A transmitted light amount sensor Sf detects the thickness and presence or absence of watermark and printing and thickness thereof. The shutter 6 is provided for preventing pulling out of a bill from outside. The shutter 6 is operated by the solenoid SOL only when the bill is inserted or returned to withdraw from the bill conveying passage 5*a*. This shutter 6 is provided immediately before the magnetic heads H1 and H2 and is withdrawn out of the bill conveying passage 5*a* when the solenoid SOL is energized whereas it is urged in a direction in which it projects into the bill conveying passage 5*a* by a spring 6*a* when the solenoid SOL is not energized. The projection of the shutter 6 in the bill conveying passage 5*a* is watched by a sensor Sc. The urging force of the spring 6*a* is such a small one as not to prevent passing of the bill when the bill already exists in the bill conveying passage 5*a*.

Figure 8:
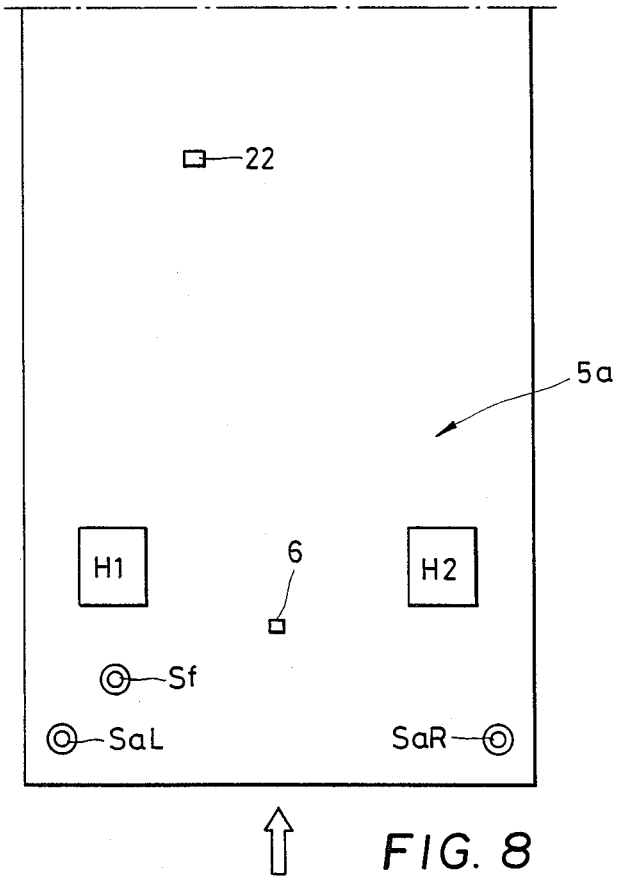
FIG. 8 is a developed view of the bill conveying passage in the same embodiment.

A developed view of the bill conveying passage 5*a*is shown in FIG. 8 in which the relationship between the respective sensors SaR, SaL, Sf, H1 and H2 and the shutter 6 is illustrated.

Operations for receiving a bill, temporarily retaining the received bill, returning the temporarily retained bill and stacking the temporarily retained bill will now be described with reference to the flow charts shown in FIGS. 9 through 12. An unillustrated control circuit provided in this bill validator performs these various operations in accordance with these flow charts.

Figure 9:
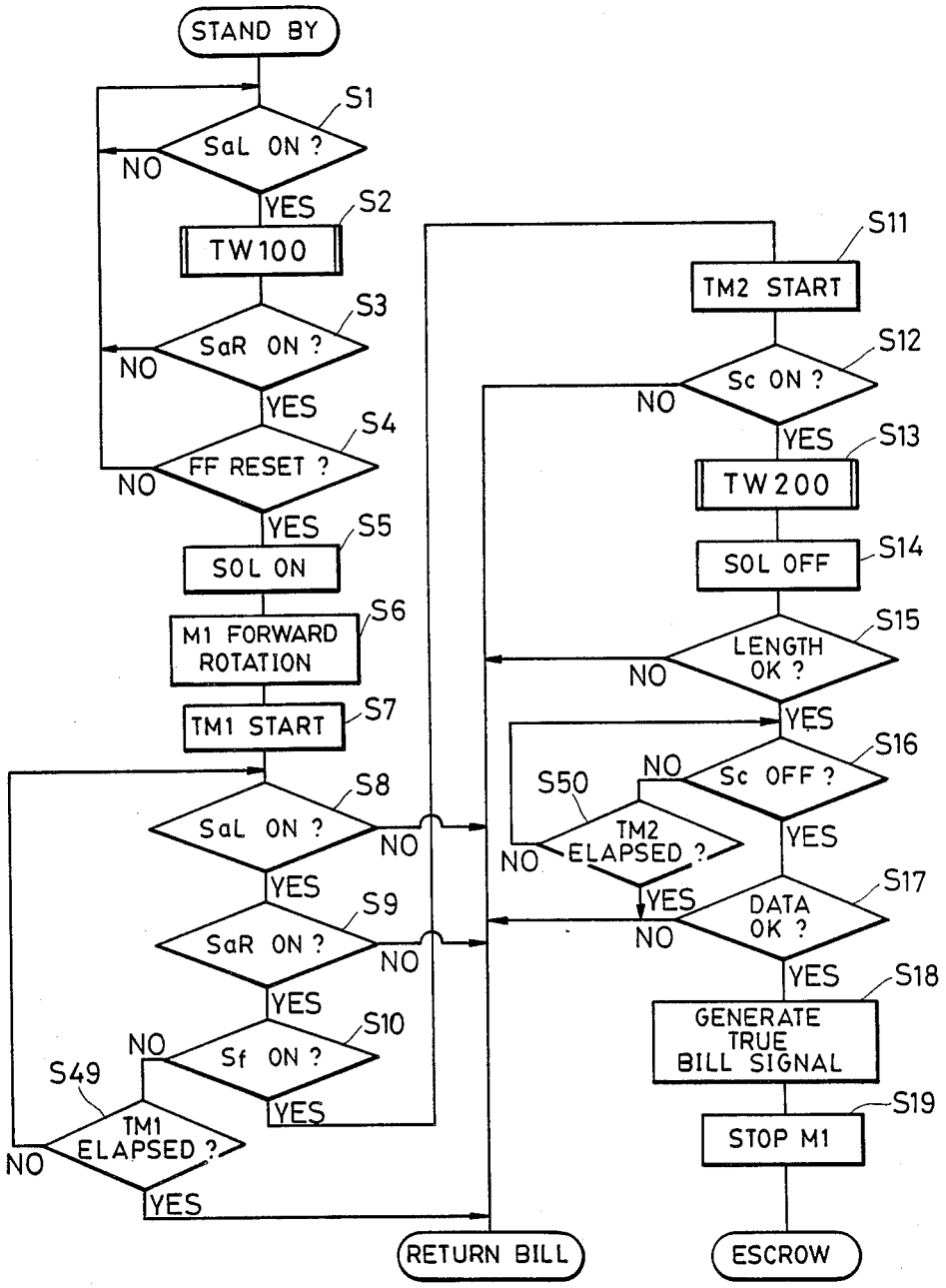
FIGS. 9 through 12 are flow charts showing an example of a control routine of various operations in the same embodiment.

FIG. 9 is a flow chart showing the operation from detection of the inserted bill to temporary retention of the bill.

The inserted bill is first examined as to whether it is of a normal width. This is judged by the fact that the left and right sensors SaR and SaL have detected interruption of light by the bill within a predetermined period of time (steps S1–S3). "TW100" in step S2 means waiting of 100 ms.

Upon detecting that the inserted bill is of a normal width, the solenoid SOL is energized (step S5) on condition that an insertion-possible-or-not flag FF is reset (YES in step S4) thereby causing the shutter 6 to be withdrawn out of the conveying passage 5a and forwardly rotating the conveying motor M1 (step S6). The inserted bill thereby is pulled into the conveying passage 5a.

Simultaneously, a timer TM1 is started (step S7) and whether the entrance sensors SaL and SaR and the transmitted light amount sensor Sf are ON or not is confirmed within the time of the timer TM1 (steps S8–S10). Whether the once inserted bill has been pulled out or not is thereby detected.

If the sensor Sf has been turned on within a predetermined period of time, a timer TM2 is started (step S11), an ON state of a switch Sc which is ON when the shutter 6 is in a position to open the conveying passage 5a is confirmed (step S12), and, after waiting for 200 ms (step S13), the solenoid SOL is turned off (step S14).

The above state is one in which the leading end of the bill has passed through the magnetic heads and conveying of the bill is still performed with the shutter 6 being lightly in abutting engagement with the surface of the bill. Accordingly, the shutter 6 does not project into the conveying passage 5a even if the solenoid SOL is deenergized and the shutter switch Sc remains in the ON state.

At a time point at which the bill has been conveyed for a predetermined period of time after it has been detected by the magnetic heads H1 and H2, the length of the bill is judged on the basis of the OFF state of the entrance sensors SaR and SaL and the ON state of the sensor Sf to determine whether it is length OK or not (step S15). If the length is OK, the processing proceeds to step S17 on the condition that the rear end of the bill has passed through the shutter 6 and the shutter switch Sc has thereby been turned off (YES of step S16) in which a comprehensive judgement is made on the basis of data detected by the respective sensors. More specifically, the data detected by the transmitted light amount sensor Sc is data concerning thickness of the bill, presence or absence of watermark and printing and thickness thereof and judgement of the direction of insertion of the bill and the optical discrimination of a true bill from a false one are performed on the basis of this data. The data detected by the magnetic heads H1 and H2 is collated with prestored magnetism distribution data prepared for each direction of insertion of the bill and the discrimination of a true bill from a false one is made by detecting whether the two data coincide with each other or not. Thus, whether results of both judgements are OK (i.e., true bill) or not is made. If the results are OK (in step S18), a ture bill signal is provided and the bill is temporarily retained. This temporary retention state is maintained until a signal representing collection of money or a signal representing returning of money is subsequently provided. If the temporary retention state has been brought about, the insertion-possible-or-not flag FF is set (step S20 in FIG. 10) whereby insertion of a subsequent bill is prohibited until this flag is reset. This temporary retention state is a state in which the rear end of the bill has just passed through the shutter 6 and, in this state, a portion of the bill nearer to the rear end thereof is held between the sensors RH and LH and the pinch roller R2.

In cases where the judgement in steps S8, S9, S12, S15 or S17 is NO, the sensor Sf is not turned on so that conveying of the bill is not performed within the time of the timer TM1 (YES in step S49) and the solenoid SOL is not deenergized within the time of the timer TM2 so that there has occurred stucking of the bill (YES in step S50), the bill is returned at this time point by a bill returning operation (RETURN BILL).

Figure 10:
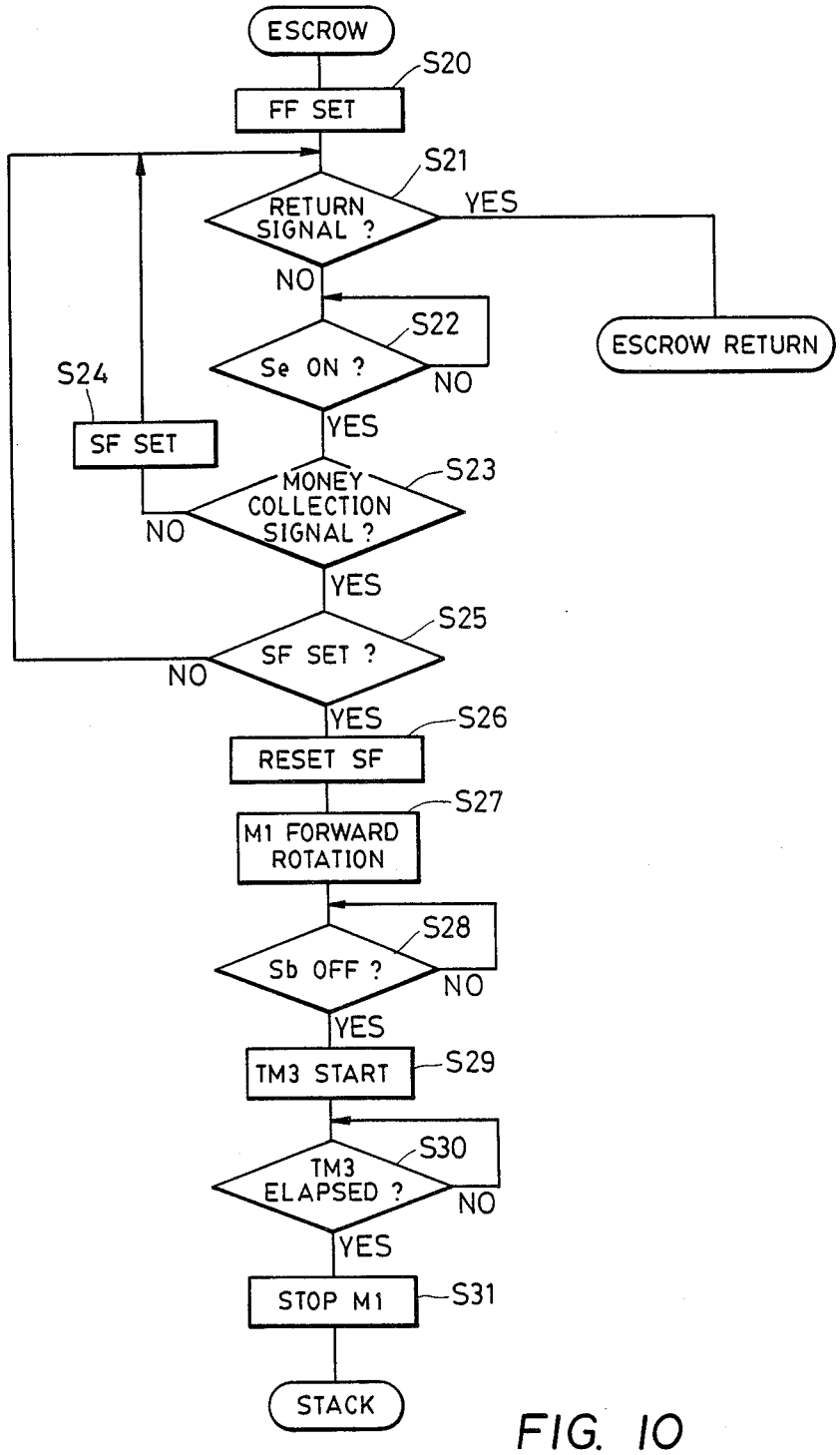

The operations from the temporary retention state to the stacking operation will now be described with reference to FIGS. 10 and 11.

In the temporary retention state, the processings are made according to the flow shown in FIG. 9. In this case, if a bill return signal is provided by the vending machine, the processing proceeds to a bill return operation (ESCRO RETURN) to be described later through NO of step S21. If the bill return signal is not provided and the safety switch Se is in the ON state (i.e., a state in which the bill accumulating box 17 is mounted in a normal state and bills can be stacked therein), a bill collection flag SF is set before the bill return signal is provided by the vending machine (step S21, YES in S22, NO in S23 and S24). If the bill collection signal is provided thereafter (YES in step S23), it is confirmed that the SF flag is in a set state and then the SF flag is reset and the motor M1 is forwardly rotated again (steps S25–S26). The bill is thereby conveyed and, when the rear end of the bill has passed by the sensor Sb, a timer TM3 is started and, upon lapse of the time of the timer TM3, the motor M1 is stopped (steps S28–S31). The bill is conveyed to the stack position in this manner.

Figure 11:
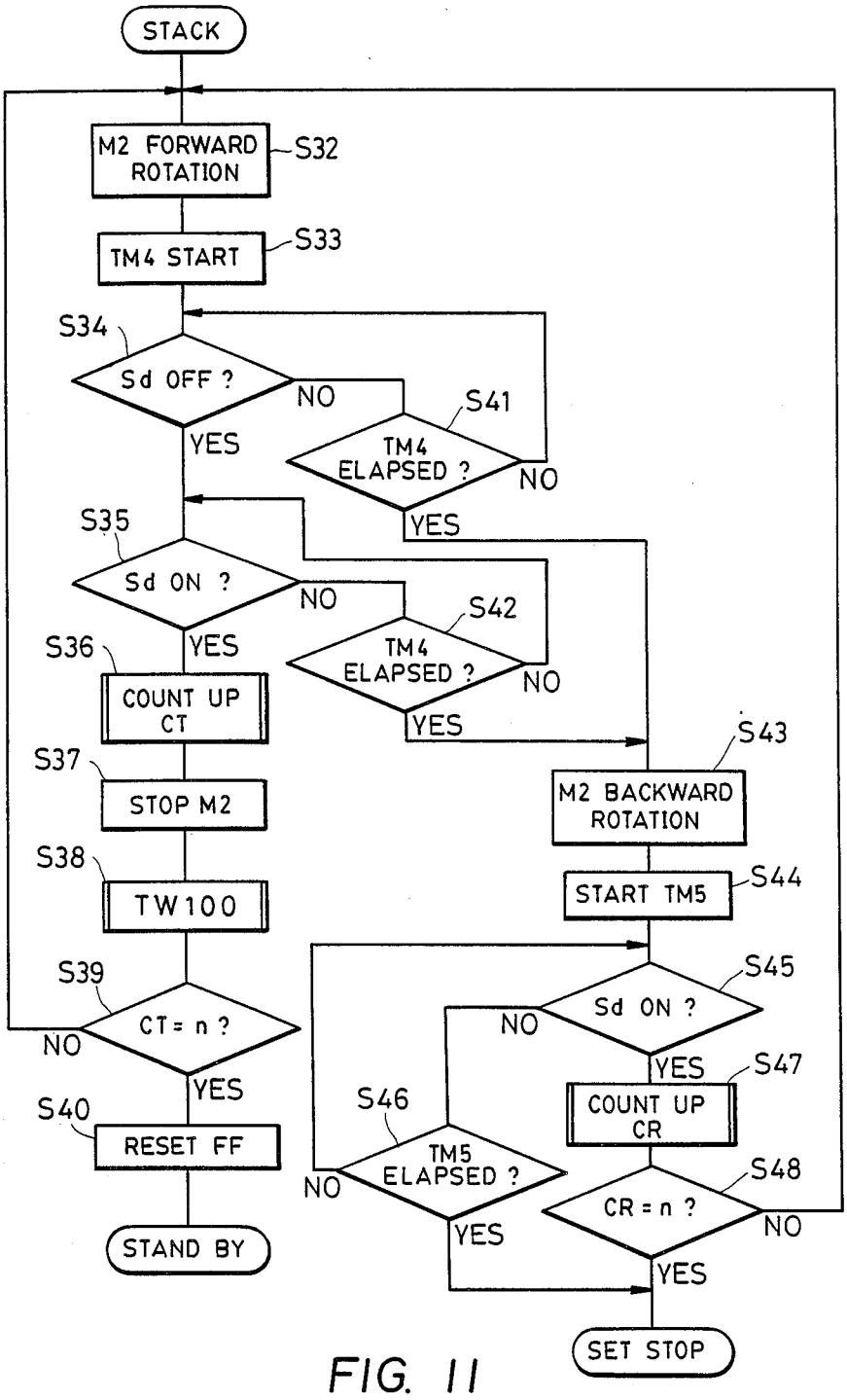

Upon conveying of the bill to the stack position, the processing is now made according to the flow shown in FIG. 11. In this flow, the reciprocating device is actuated for two cycles by rotation of the motor M2 to perform the stacking operation. More specifically, the motor M2 is rotated forwardly (S32), a timer TM4 is started (S33) and, on condition that the carrier switch Sd has been switched from the OFF state to the ON state within the time of the timer TM4 (on the assumption that this is a normal operation of the carrier switch Sd), a counter CT is caused to count up by 1 (steps S34, S35 and S36). Nextly, the motor M2 is stopped (S37), waiting time of 100 ms is set (S38) and whether the count of the counter CT is a predetermined value n (e.g., 2) or not is examined. If the count is not n, the processing returns to step S32 and the above described routine is repeated. By the processings of steps S32–S37, the reciprocating device performs reciprocating motion by one cycle thereby placing the bill in the bill accumulating box 17. Each time this reciprocating device has made the reciprocating motion of one cycle, the counter CT counts up by 1. For ensuring accurate bill receiving operation, an arrangement is made in this embodiment so that a single bill is received by reciprocating motions of n times of the reciprocating device. Therefore, upon reaching of CT=n, the processing finishes the above described routine and proceeds to step S40 in which the FF flag is reset. In this manner, the stacking operation is completed and the processing returns to a standby state (STAND BY).

If the carrier switch Sd does not perform its normal operation within the time of the timer TM4 which starts with rotation of the motor M2, steps 41 and 42 become YES and the processing proceeds to step S43. The motor M2 is rotated reversely and forwardly several times by repeating the routine of steps S43–48, S32–S35, S41 and S42. If the normal stacking operation is not restored, it is assumed that the accumulating box 17 is full or out of order and a set stop operation (SET STOP) is performed. That is, a timer TM5 is started during reverse rotation of the motor M2 (step S44) and, on condition that the carrier switch Sd has been turned on during this time, the counter CT is caused to count up by 1 (S45–S47) and the processing returns to step S32.

Figure 12:
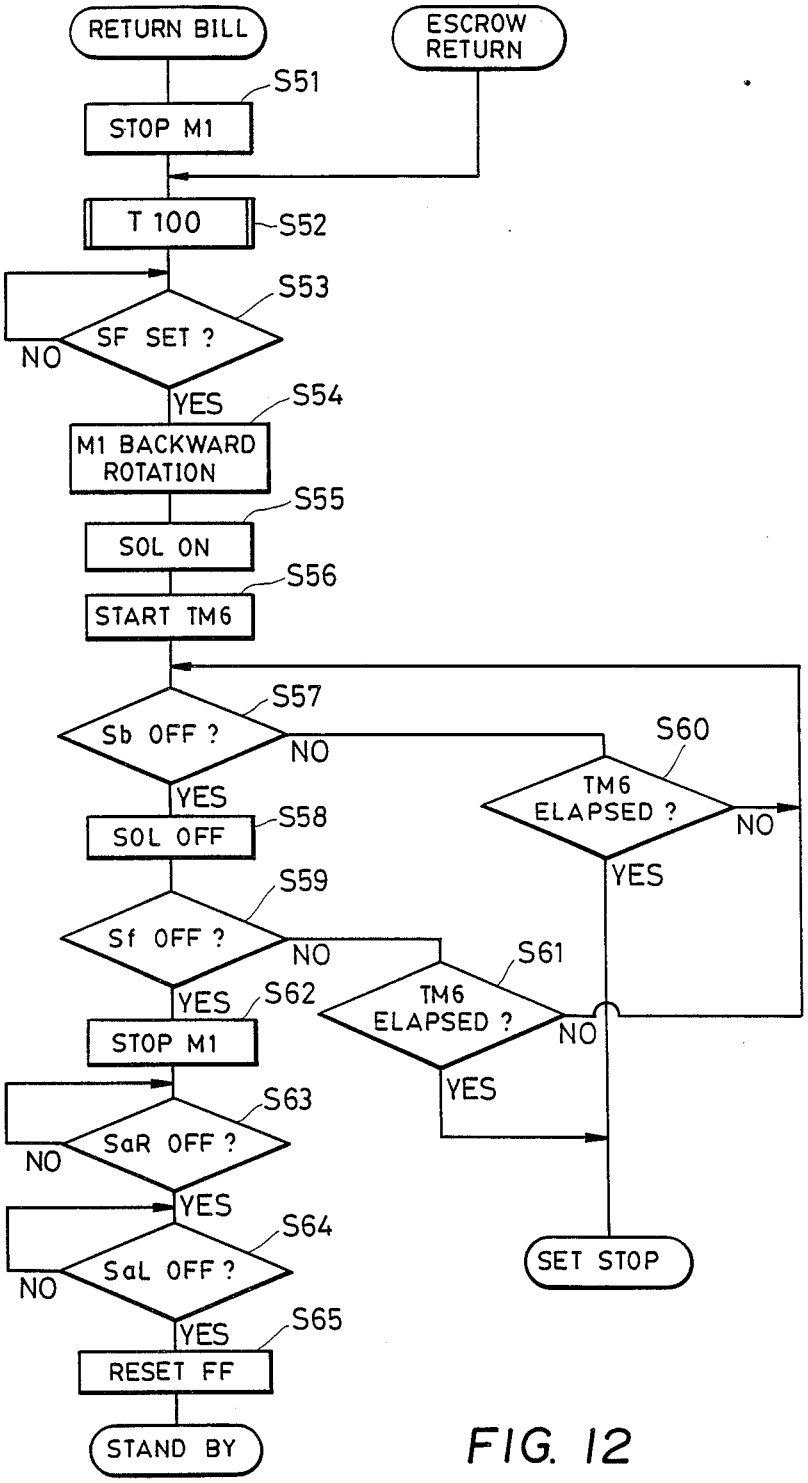

An operation for returning a bill will now be described with reference to FIG. 12.

If an order for returning an inserted bill has been issued in the course of discriminating a true bill from a false one (i.e., in the case of a false bill), a routine of RETURN BILL is carried out. Namely, the motor M1 which has been rotated is stopped and, after a predetermined length of waiting time, the motor M1 is reversely rotated on condition that the bill collection flag SF is reset thereby conveying the bill reversely (steps S51–S54). Nextly, the solenoid SOL is energized to enable the bill to pass (step S55). Then, a timer TM6 is started (step S55) and, on conditions that the sensor Sb has been switched from the ON state to the OFF state (i.e., the rear end of the reversely conveyed bill has passed by the sensor Sb) and that the sensor Sf has been switched from the ON state to the OFF state (i.e., the rear end of the reversely conveyed bill has passed by the sensor Sf), it is judged that a normal bill returning operation has been performed (steps S57–S61). Since the bill is certainly positioned above the shutter 6 when the rear end of the bill has passed by the sensor Sb (YES in S57), the solenoid SOL may be deenergized at this time (step S58). Upon passing of the rear end of the bill by the sensor Sf (YES in S59), the motor M1 is stopped (step S62). At this time, the bill has been returned to the bill insertion slit 1. Upon pulling out of the bill from the bill insertion slit 1, turning off of the entrance sensors SaR and SaL is confirmed (steps S62, S63), the flag FF is reset (S64) and the bill returning operation is completed.

In a case where a bill return signal is provided after a true bill signal has once been issued and the inserted bill has been temporarily retained in the above described manner, a routine of ESCROW RETURN is carried out. In this case, the motor M1 has already been stopped by the routine of step S19 in FIG. 8 so that step S51 in FIG. 11 is not performed but the above described steps S52–S64 are performed. Since the temporarily retained bill is held between the magnetic heads H1 and H2 and the pinch roller R2, passing of the reversely conveyed bill can be made smoothly.

As detection means for detecting passing of the rear end of the inserted bill by the shutter 6 preventing pulling out of the bill, other means than the sensor Sc which detects withdrawal of the shutter 6 may be used.

As described above, according to the invention, the vertical mounting direction of the accumulating box and the vertical mounting direction of the insertion slit cover can be made easily by changing of mounting positions of a few component parts and, accordingly, placing of the bill validator main body upside down with its bill insertion slit being located in its upper portion or lower portion can be easily carried out. Consequently, a bill validator of a type in which the bill insertion slit is located in the upper portion and one of a type in which the bill insertion slit is located in the lower portion can both be realized only by a slight change effected on the same bill validator so that a remarkable reduction in the manufacturing cost can be attained.

Further, according to the invention, since the magnetic heads H1 and H2 are provided at the rearmost portion of the bill discrimination means, the bill pulling out preventing member (6) is provided in a prior stage thereof, and conveying of an inserted bill is stopped by the detection means (Sc) detecting passing of the rear end of the inserted bill by this member (6) and the inserted bill is temporarily retained, the end portion of the bill can be held between the magnetic heads and the pinch roller in the temporarily retained state. Accordingly, returning of the bill can be made smoothly without the end portion of the bill being blocked by the magnetic heads and the pinch roller.

What is claimed is:

1. A bill validator comprising:

a vertically extending main body;

a bill insertion section provided in the front portion of said main body;

bill conveying means including a first conveying passage extending from said bill insertion section into said main body and a second conveying passage extending vertically in the longitudinal direction of said main body for conveying a bill inserted from said bill insertion section along said first and second conveying passages;

discrimination means for discriminating a true bill from a false bill among bills inserted from said bill insertion section;

a bill accumulating box detachably mounted in the rear portion of said main body; and accumulation means for transferring a bill which has been estimated to be a true bill from said second conveying passage to said bill accumulating box in the rear of said second conveying passage thereby to accumulate said bill in said bill accumulating box;

said bill accumulating box including a first projection provided in the upper portion of a side thereof and a second projection provided in the lower portion of the side thereof, said main body being provided on a side thereof with a latch member engaging with said first projection and a support member supporting said bill accumulating box through said second projection, said latch member being displaceable between a holding position and a releasing position, being engaged with said first projection in the holding position and, in the releasing position, being disengaged from said first projection and thereby being capable of tilting said bill accumulating box rearwardly about a point of engagement between said support member and said second projection, said main body being capable of being used in both a normal state and an upside down state while retaining the configuration of the bill insertion section relative to the main body, said bill accumulating box being mounted to said main body in such a manner that said first projection of said bill accumulating box is positioned above said second projection where said main body is used in said normal state and that said first projection of said bill accumulating box is positioned above said second projection where said main body is used in said upside down state, and, in accordance with this mounting, mounting positions of said latch member and said support member in said main body being changed to positions corresponding to said first and second projections.

2. A bill validator as defined in claim 1 wherein said latch member comprises a lever having a recess engaging with said first projection and being capable of displacing about a pivot between said holding position and said releasing position and a spring urging said lever in the direction of said holding position.

3. A bill validator as defined in claim 1 wherein said discrimination means is provided along said first conveying passage, said discrimination means comprises an optical sensor and a magnetic sensor as component elements and this magnetic sensor is disposed in the rearmost location of the arrangement of these component elements of said discrimination means, and said bill validator further comprises;

a bill pulling out preventing member provided in a stage prior to said magnetic sensor and projecting into or withdrawing from said conveying passage;

drive means for withdrawing said bill pulling out preventing member from said conveying passage when the bill is inserted and returned; and detection means for detecting that the rear end of the inserted bill which is being conveyed in said bill conveying passage has passed by the location of said bill pulling out preventing member, the bill being temporarily retained in said conveying passage by stopping conveying of the bill in response to an output of said detection means.

4. A bill validator comprising:

a bill insertion slit;

bill conveying means including a conveying passage communicating with said bill insertion slit and conveying a bill inserted from said bill insertion slit along said conveying passage;

discrimination means for discriminating a true bill from a false one among bills inserted from said bill insertion slit including component elements for discriminating the bill along said conveying passage, said component elements including at least a magnetic sensor which is disposed at the rearmost location of the arrangement of said component elements;

a bill pulling out preventing member provided in a stage prior to said magnetic sensor and projecting into or withdrawing from said conveying passage;

drive means for withdrawing said bill pulling out preventing member from said conveying passage when the bill is inserted and returned;

detecting means for detecting that the rear end of the inserted bill which is being conveyed along said conveying passage has passed by the location of said bill pulling out preventing member;

temporary retention means for temporarily retaining the bill in said conveying passage, at a temporary retention location such that at least the first end of the bill has passed the magnetic sensor and the rear end of the bill has not passed the magnetic sensor, by stopping conveying of the bill in response to an output of said detection means;

reverse feeding means for reversely feeding the bill, which has been temporarily retained by said temporary retention means, from said temporary retention location to said bill insertion slit along said conveying passage in response to a bill return command, such that said reverse feeding of said bill is not blocked at said magnetic sensor location;

a bill accumulating box for accumulating accepted bills; and accumulation means for accumulating the bill which has been temporarily retained by said temporary retention means in said bill accumulating box in response to a bill collection command.

5. A bill validator as defined in claim 4 wherein said detection means consists of a switch detecting that said bill pulling out preventing member is withdrawn from said conveying passage, said bill pulling out preventing member is constantly urged by a spring to project into said conveying passage, is withdrawn from said conveying passage by said drive means against the force of said spring before the forward end of the bill arrives, is urged into said conveying passage by said spring with driving by said drive means being ceased during passing of the bill and is caused to project into said conveying passage when the rear end of the bill has passed by, and said switch is turned off by projection of said bill pulling out preventing member whereby passing of the rear end of the bill by the location of said bill pulling out preventing member is detected.

6. A bill validator comprising:

a vertically extending main body;

a bill insertion section provided in the front portion of said main body;

bill conveying means including a first conveying passage extending from said bill insertion section into said main body and a second conveying passage extending vertically in the longitudinal direction of said main body for conveying a bill inserted from said bill insertion section along said first and second conveying passages;

discrimination means for discriminating a true bill from a false bill among bills inserted from said bill insertion section;

a bill accumulating box detachably mounted in the rear portion of said main body; and accumulation means for transferring a bill which has been estimated to be a true bill from said second conveying passage to said bill accumulating box in the rear of said second conveying passage thereby to accumulate said bill in said bill accumulating box;

said bill accumulating box including a first projection provided in the upper portion of a side thereof and a second projection provided in the lower portion of the side thereof, said main body being provided on a side thereof with a latch member engaging with said first projection and a support member supporting said bill accumulating box through said second projection, said latch member being displaceable between a holding position and a releasing position, being engaged with said first projection in the holding position and, in the releasing position, being disengaged from said first projection and thereby being capable of tilting said bill accumulating box rearwardly about a point of engagement between said support member and said second projection, said main body being capable of being used in both a normal state and in an upside down state, said bill accumulating box being mounted to said main body in such a manner that said first projection of said bill accumulating box is positioned above said second projection where said main body is used in said normal state and that said first projection of said bill accumulating box is positioned above said second projection where said main body is used in said upside down state, and, in accordance with this mounting, mounting positions of said latch member and said support member in said main body being changed to positions corresponding to said first and second projections, wherein said bill insertion section comprises a case having an opening communicating with said first conveying passage as a bill insertion slit and a cover covering the bill insertion slit of this case, said cover having a pivot at an end thereof and said case being provided in the upper and lower portion thereof with support portions capable of detachably supporting said pivot of said cover, and said pivot of said cover being mounted to one of said support portions so that said cover covers said bill insertion slit with said pivot of said cover being positioned in the upper portion thereof in both cases where said main body is used in an upside down state and where said main body is used in said normal state whereby said bill insertion slit can be opened by lifting said cover upwardly about said pivot.

7. A bill validator as defined in claim 6 wherein said upper and lower support portions in said case consist respectively of a pair of channels formed in the inner surfaces of both sides of said case.

* * * * *